US005819330A

United States Patent [19]

Yokel

[11] Patent Number: 5,819,330

[45] Date of Patent: Oct. 13, 1998

[54] TOILET ENHANCEMENT

[76] Inventor: Don Yokel, 12705 Lambro Pl., Tampa, Fla. 33624

[21] Appl. No.: 888,180

[22] Filed: Jul. 3, 1997

[51] Int. Cl.[6] ..... E03D 1/14; E03D 3/12

[52] U.S. Cl. ..... 4/325; 4/414

[58] Field of Search ..... 4/324, 325, 405, 4/406, 408, 410, 411, 413, 414

[56] References Cited

U.S. PATENT DOCUMENTS

| | | | |
|---|---|---|---|
| 2,635,691 | 4/1953 | Fillians | 4/406 X |
| 4,172,299 | 10/1979 | del Pozo | 4/326 |
| 4,831,670 | 5/1989 | Velasquez | 4/408 |
| 4,878,256 | 11/1989 | Bagwell | 4/326 |
| 5,175,893 | 1/1993 | Navarrete | 4/326 |
| 5,333,332 | 8/1994 | Kam | 4/326 |
| 5,544,368 | 8/1996 | Wang | 4/325 X |
| 5,699,563 | 12/1997 | McClure | 4/325 |

*Primary Examiner*—Charles E. Phillips
*Attorney, Agent, or Firm*—Joseph N. Breuax

[57] ABSTRACT

A toilet enhancement which utilizes a flush handle having push-button settings for light and heavy flushes, the heavy setting fully raising the flush lever in the toilet tank, the lever in turn fully raising the flap valve at the bottom of the tank and allowing all of the water to flow out into the bowl of the toilet, the light flush setting shifting a cam connected to the flush handle so that the handle rotates slightly before coming into contact with the flush lever, thereby raising the lever and the flap valve to positions which are lower than their fully raised positions, the flap valve being connected to a timing gear mechanism which controls the rate at which the valve returns to its seated position, so that the flap valve closes from its partially raised position in an amount of time which allows approximately half of the water in the tank to flow out to the bowl.

16 Claims, 3 Drawing Sheets

TOILET ENHANCEMENT

TECHNICAL FIELD

The present invention relates to devices for plumbing and sewage systems and more particularly to enhancements which can be adapted to standard toilets in order to provide selective flushing capability through the use of a flush handle which raises the flush lever to one of two positions depending on the setting of a flush selector button, the flap valve of the toilet being raised by an amount corresponding to the amount the flush lever is raised, the flap valve then being returned to its seated position at a rate controlled by a timing mechanism, thus allowing either a full tank of water or a half tank of water to be used in the flushing of the toilet.

BACKGROUND OF THE INVENTION

Because of increased demands on fresh water supplies, many regions have experienced shortages and it is now a common perception that there is a continuing need to reduce water usage and conserve existing water supplies. Various studies have therefore been undertaken to determine the devices and activities which have the highest consumption of water and which can possibly use less water.

One type of devices identified by these studies-is a toilet. A typical toilet can use three gallons of water or more each time the toilet is flushed. A number of low-consumption toilets which have tanks that hold less than three gallons have been designed as a response to the typically high consumption by standard toilets. These low-consumption toilets, however, may not flush effectively and consequently may require more than a single flush. In this case, the entire purpose, of the low-consumption design has been defeated.

There have also been several toilet designs which utilize a standard-sized water tank, but which do not use the entire tank on each flush. These toilet designs use dual flush valves, each of which has its own outlet through which water can flow from the tank to the bowl of the toilet, and it own flap valve which, when seated in the outlet, covers the outlet and prevents water from leaving the tank. The two valves are located at different depths within the tank, one at approximately half the depth of the other so that when the higher valve is opened, a half-volume flush is effected and when the lower valve is opened, a full-volume flush is effected.

One of the problems with the low-consumption toilet designs described above is- that these improvements involve the redesign of standard toilets and require that a standard toilet be replaced with the new design in order to obtain the improved performance. The replacement of the standard toilet is time-consuming and the cost is often prohibitive, so that the more wasteful standard toilet is used instead of a low-consumption toilet.

SUMMARY OF THE INVENTION

It is thus an object of the invention to provide a toilet enhancement that conserves water.

It is a further object of the invention to provide a toilet enhancement that can alternately utilize either a full tank or a half tank of water per flush.

It is a still further object of the invention to provide a water-conserving toilet enhancement that can be installed on a standard toilet.

It is a still further object of the invention to provide a toilet enhancement that allows full or partial flushes without requiring separate sets of flap valves and associated flush handle linkages.

Accordingly, a toilet enhancement is provided. The toilet enhancement utilizes a flush handle which has push-button settings for light and heavy flushes, the heavy setting fully raising the flush lever in the toilet tank, the lever in turn fully raising the flap valve at the bottom of the tank and allowing all or the water to flow out into the bowl of the toiler. The light flush setting shifts a cam connected to the flush handle so that the handle rotates slightly before coming into contact with the flush lever, thereby raising the lever and flap valve to positions which are lower than their fully raised positions. The flap valve is connected to a timing gear mechanism which controls the rate at which the valve returns to its seated position, so that the flap valve closes from its partially raised position in an amount of time which allows approximately half of the water in the tank to flow out to the bowl.

BRIEF DESCRIPTION OF DRAWINGS

For a further understanding of the nature and objects of the present invention, reference should be had to the following detailed description, take in conjunction with the accompanying drawings, in which like elements are given the same or analogous reference numbers and wherein.

DESCRIPTION OF THE EXEMPLARY EMBODIMENT

Figure 1:
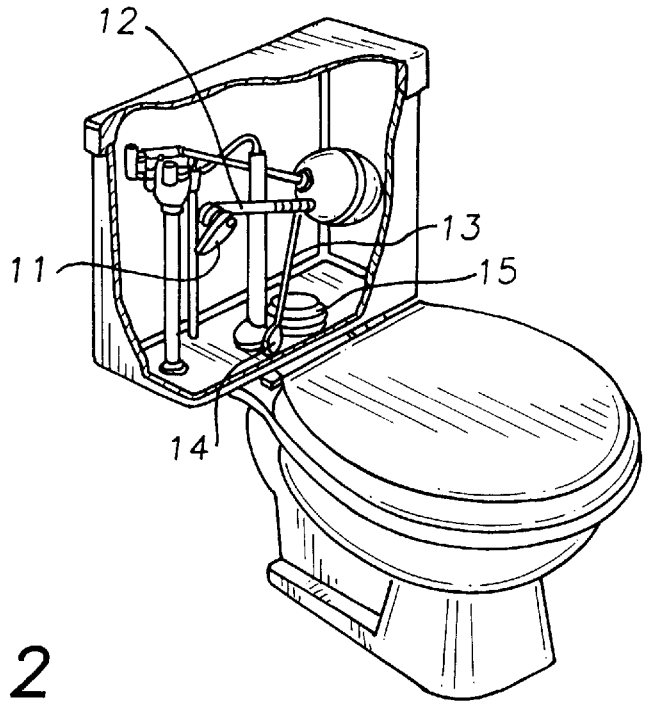
FIG. 1 is a cutaway perspective view of a standard toilet with the invention installed in the tank.

Referring to FIG. 1, the preferred embodiment of the invention is shown installed in the tank of a standard toilet. The wall of the tank is cut away to show the components within the tank. The invention comprises flush handle 11, flush lever 12, gear pull 13, timing gear mechanism 14 and flap valve 15.

Figure 2:
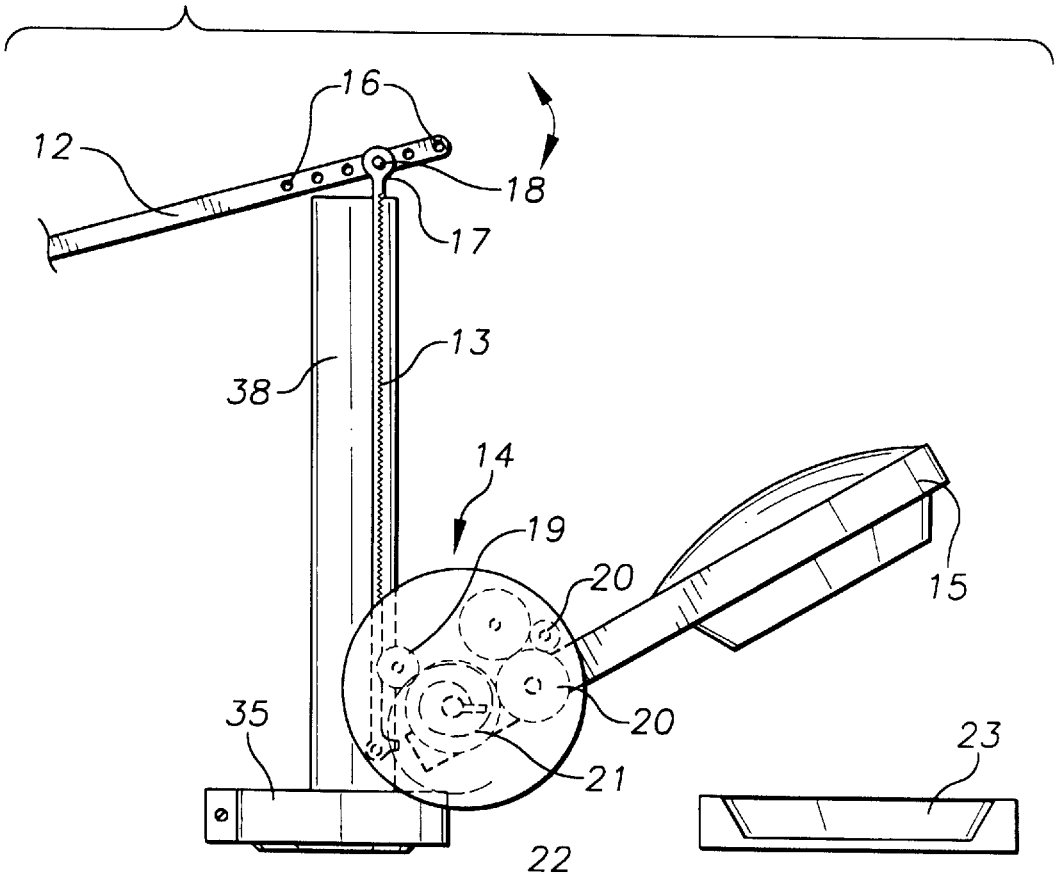
FIG. 2 is a side plan view of the preferred embodiment of the invention.

The side plan view of FIG. 2 shows the invention in more detail. Flush lever 12 has mounting holes 16 to which gear pull 13 is, attached via mounting eyelet 17. Pivot bolt 18 is inserted through mounting eyelet 17 and mounting hole 16 so that flush lever 12 and gear pull 13 are pivotally connected. Gear pull 13 extends downward into the timing gear mechanism 14. Timing gear mechanism 14 is connected to and held in place by attachment frame 35 which is installed at the base of overflow tube 38. Attachment frame 35 also incorporates flap valve shaft 36, about which flap valve 15 pivots.

Gear pull 13 moves linearly upward as flush handle 11 is depressed, the linear motion allowing the gear pull to maintain contact with first timing gear 19 and cause this gear to rotate. The gear pull extends through an aperture in timing gear housing 34 (see FIG. 5) and is thereby held in place against the timing gear. As first timing gear 19 rotates, spring 22 is wound and flap valve 15 is lifted away from valve seat 23 to allow water to flow out of the tank and into the bowl of the toilet.

When flush handle 11 is released, gear pull 13 is moved to its lowered position, but flap valve 15 does not immediately return to its lowered, seated position against valve seat 23. Instead, timing gear mechanism 14 slowly lowers flap valve 15 into its seated position. The time which it takes for flap valve 15 to return from a raised position to its seated position depends upon the timing gear mechanism and the amount by which the flap valve is raised. Timing gear mechanism 14 operates in a manner similar to a simple egg timer or kitchen timer—the flap valve is manually moved to its raised position by the action of the gear pull and then the timing gear mechanism slowly moves the flap valve back to its seated position. The gearing of the mechanism in the invention will, of course, cause the flap valve to return to its seated position in an appropriate time which is very likely less than the time required to cook an egg.

For the timing gear mechanism used in the preferred embodiment, the time required to return the flap valve to its seated position is approximately proportional to the angular displacement of the flap valve from its seated position to the raised position. Thus, if raising the flap valve 90 degrees allows the toilet tank to drain almost entirely, raising the flap valve 45 degrees allows approximately half of the water in the tank to flow into-the bowl.

Figure 3A:
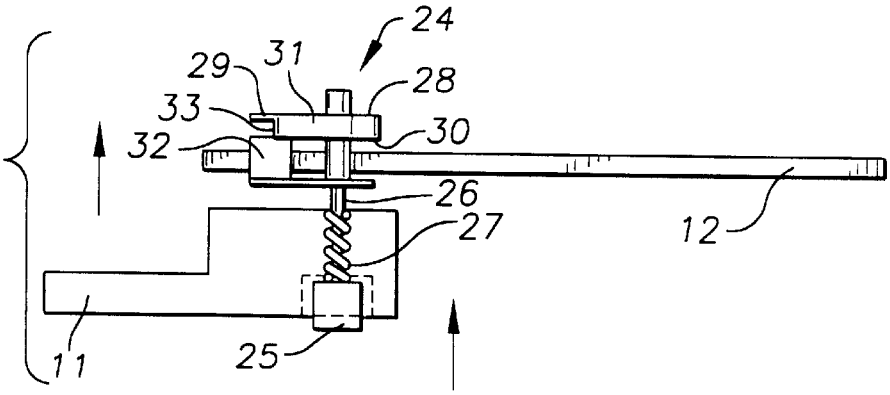
FIG. 3*a* is a top plan view of the flush handle and lever assembly of the preferred embodiment of the invention with the push-button in its full-flush position.
Figure 3B:
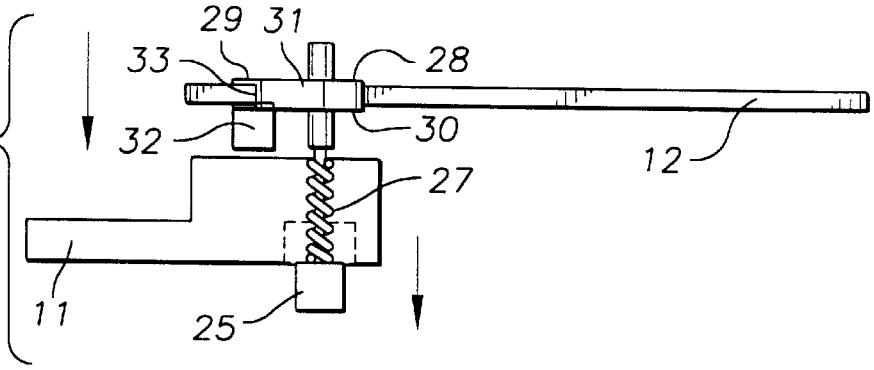
FIG. 3*b* is a top plan view of the flush handle and lever assembly of the preferred embodiment of the invention with the push-button in its half-flush position.
Figure 3C:
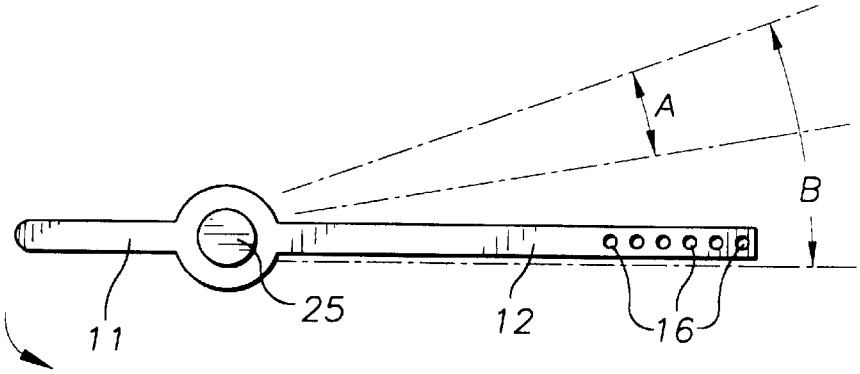
FIG. 3*c* is a side plan view of the flush handle and lever assembly of the preferred embodiment of the invention showing the travel of the flush lever for full and half flushes.

Referring to FIG. 3, the flush handle 11 and flush lever 12 are shown. The preferred embodiment of the invention utilizes a spring-loaded push-button mechanism 24 to control the level to which the flap valve 15 is raised. Push-button mechanism 24 has a button 25, a central shaft 26, a spring 27 and a cam 28. Shaft 26 goes through flush handle 11 and flush lever 12 so that, when the flush handle is depressed, the flush lever is raised and the toilet is flushed.

The flush handle and flush lever, however, are not rigidly connected to the shaft as in a standard toilet. Instead, the flush handle 11 is slidingly attached to the shaft 26 so that the shaft can move axially, but not rotationally within the flush handle. The shaft 26 can move both axially and rotationally within the flush lever 12. Cam 28 is fixedly attached to shaft 26 and does not move either axially or rotationally with respect to the shaft.

In the preferred embodiment, cam 28 has two disks 29, 30 which are perpendicularly aligned with shaft 26. Tab 32 is rigidly connected to disk 30 and extends outward from disk 30 along the direction of shaft 26.Surface 31 connects disks 29 and 30 along a portion of their outer peripheries and has an edge 33 which is angularly displaced (with respect to the axis of shaft 26) from tab 32. When flush handle 11 is in its raised position and flush lever 12 is in its lowered position, tab 32 is at the same level as the upper surface of flush lever 12, while edge 33 is at a level slightly above the upper surface of flush lever 12.

Figure 4A:
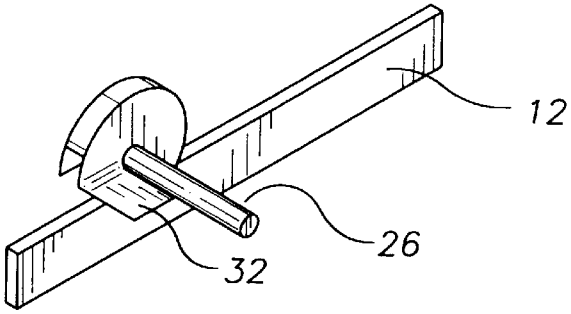
FIG. 4*a* is a perspective view of the cam and lever of the preferred embodiment of the invention with the push-button in its full-flush position.

Push-button mechanism 24 has two positions—one for a full flush and one for a half flush. FIGS. 3*a* and 4*a* show button 25 in the inward, full-flush position in which cam 28 is shifted so that tab 32 is above flush lever 12. With the button and cam in this position, depressing the flush handle 11 causes cam 28 to immediately contact flush lever 12 and rotate the flush lever upward by angular distance B, which is the same amount that the flush handle is rotated downward. This is equivalent to the normal operation of a standard flush mechanism. Push-button mechanism 24 operates in a manner similar to a push-button lock in a door knob in that when the button is pushed, it remains in its inward position until after the flush handle is depressed and returns to its outward position when the flush handle returns to its non-depressed position.

Figure 4B:
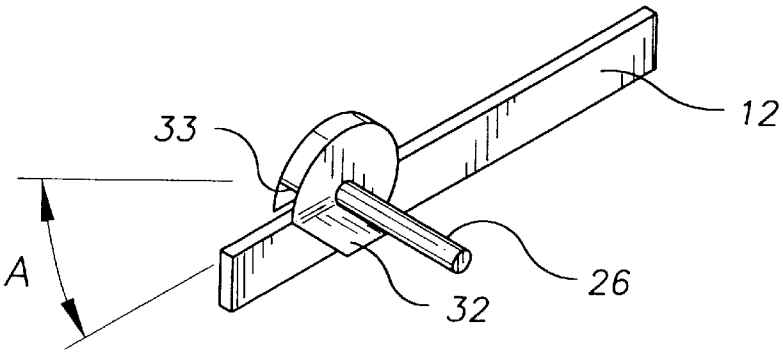
FIG. 4*b* is a perspective view of the cam and lever of the preferred embodiment of the invention with the push-button in its half-flush position.

FIGS. 3*b* and 4*b* show button 25 in its outward, half-flush position in which cam 28 is shifted so that flush lever 12 is aligned between disks 29 and 30. With the button and cam in this half-flush position, depressing the flush handle 11 causes cam 28 to rotate through a certain angular distance A before edge 33 comes into contact with flush lever 12. Then, fully depressing flush handle 11 causes flush lever 12 to rotate through an angular distance of B–A.

The flush handle 11 and flush lever 12 of the preferred embodiment of the invention are manufactured from metal using the same methods used in the manufacture of the standard components. These parts can be made using die casting, lost wax casting or metal stamping and punching processes. The push-button and cam assembly can be manufactured from metal and plastic parts using these same metal casting and stamping processes as well as plastic injection molding.

The gear pull, attachment frame and timing gear mechanism of the invention are made of nylon and are injection molded. Both the gears and the housing of the timing ear mechanism, are manufactured using this process. The flap valve is manufactured from rubber using a vulcanization process. The flap valve of the invention is essentially the same as that of a standard toilet except for its attached to the timing gear mechanism 14, which controls its movement.

Figure 6:
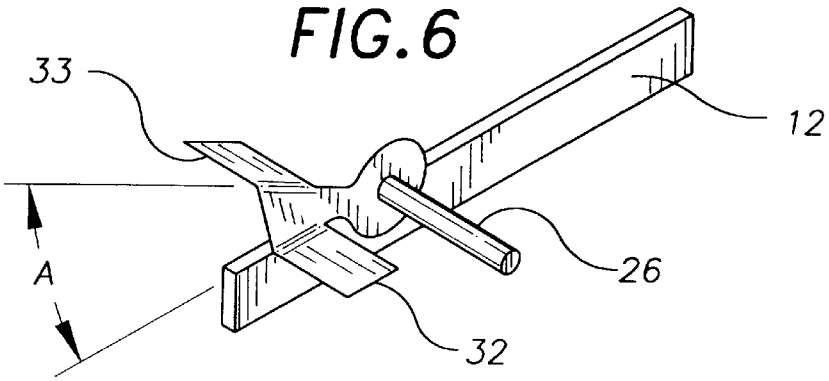
FIG. 6 is a perspective view of an alternate embodiment of the cam.

Alternate embodiments of the invention can use different forms of the cam 28 and timing gear mechanism 14. For example, the cam need not take the form of two parallel disks with a peripheral surface and an outwardly extending tab. The cam could instead be as simple as a lever with two angularly displaced tabs as shown in FIG. 6. The invention also contemplates embodiments in which there are not only two predetermined flush positions. If the flush handle and flush lever of a standard toilet are used in conjunction with a timing mechanism which lowers the flap valve, a half flush can be obtained by simply depressing the flush handle halfway. The flush amount can thereby be continuously varied from no flush at all to a full flush.

Figure 5:
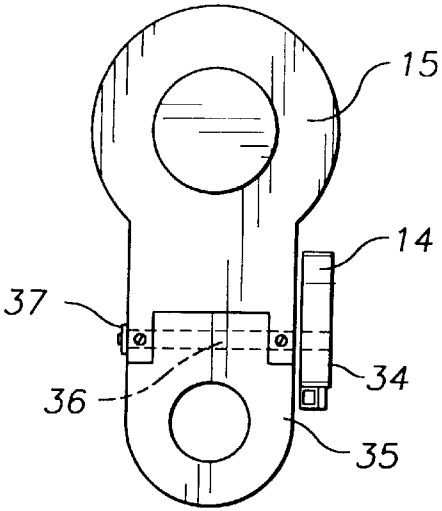
FIG. 5 is a top plan view of the flap valve and timing mechanism housing of the preferred embodiment of the invention.

Similarly, the timing gear mechanism need not be the spring-loaded egg-timer mechanism of the preferred embodiment and could take the form of a simple frictional means to control the speed at which the flap valve drops (such an embodiment would require that the flap valve be heavy enough to fall to a closed, seated position when there is still water in the tank.) The timing gear mechanism can also be used with an external spring which forces the flap valve closed, in which case the timing gear mechanism may or may not have an internal spring. FIG. 5 shows the optional external spring 37.

It is also envisioned that the mechanical linkage between the flush lever and flap valve could comprise means other than the gear pull to raise the flap valve. For example, the invention could utilize a standard chain which connects the end of the flush lever to the flap valve so that the valve is raised by the upward force of the chain and lowered by the action of the timing gear mechanism.

The invention can be installed in a standard toilet by replacing the standard flush handle, flush lever, chain and flap valve with the components of the invention. First, the water supply, is turned off and the standard flush handle and flush lever are removed. The flush handle, flush lever and gear pull of the invention are then installed. The standard flap valve is then removed and the timing gear mechanism and flap valve are installed by securing the attachment base around the bottom of the overflow tube. The gear pull is then inserted into the timing gear housing, the water supply is turned on, and the invention is ready for use.

The invention is used by simply depressing the flush handle in the same manner as a standard toilet. If the push-button is in its outward position, a full flush is selected. If the push-button is in its inward position, a half flush is selected. After a half flush, the push-button returns to its outward, full-flush position.

It can be seen from the preceding description that a device for adapting standard toilets in order to provide selective flushing capability through the use of a flush handle which raises the flush lever to one of two positions depending on the setting of a flush selector button, the flap valve of the toilet being raised by an amount corresponding to the amount the flush lever is raised, the flap valve then being returned to its seated position at a rate controlled by a timing mechanism, thus allowing either a full tank of water or a half tank of water to be used in the flushing of the toilet, which conserves water, can alternately utilize either a full tank or a half tank of water per flush, can be installed on a standard toilet and allows full or partial flushes without requiring separate sets of flap valves and associated flush handle linkages has been provided.

What is claimed is:

1. A toilet enhancement comprising:

a flap valve which has a seated position and a range of raised positions;

a flush handle connected to a flush lever, said flush handle and said flush lever each extending laterally from a first axis about which said flush handle and said flush lever pivot, said flush lever being raised by depression of said flush handle and said flush lever being lowered after the release of said flush handle;

a mechanical linkage connecting said flap valve to said flush lever, said flap valve being raised by said mechanical linkage from said seated position to said range of raised positions when said flush lever is raised, said linkage including, a mechanical timing mechanism connected to said flap valve, said timing mechanism lowering said flap valve from said range of raised positions to said seated position at a controlled rate.

2. The toilet enhancement of claim 1, wherein said flush lever has a lowered lever position, a first raised lever position and a second raised lever position, said second raised lever position being midway between said lowered lever position and said first raised lever position.

3. The toilet enhancement of claim 2, wherein said timing mechanism comprises a plurality of gears, each of said gears engaging at least one other of said gears, rotation of one of said gears causing said engaged gears to rotate, said flap valve being frictionally engaged with one of said gears, the raising of said flap valve causing slippage between said flap valve and said, frictionally engaged gear, said raised flap valve returning to said seated position without said slippage between said flap valve and said frictionally engaged gear.

4. The toilet enhancement of claim 3, further comprising a push-button mechanism having:

a shaft, said flush handle being pivotally connected to said flush lever by said shaft;

a push-button connected to said shaft and extending through said flush handle;

a cam connected to said shaft, said cam being adjacent to said flush lever, said cam rotating by the same amount as said flush handle;

said push-button mechanism having a first button position and a second button position, said cam having a first contact surface which is in contact with said flush lever when said push-button mechanism is in said first button position and causes said flush lever to rotate by the same amount as said flush handle, said cam having a second contact surface which is aligned with said flush lever when said push-button mechanism is in said second button position, said second contact surface being out of contact with said flush lever when said flush handle is not depressed and being in contact with said flush lever when said flush handle is depressed halfway, full depression of said flush handle thereby causing said flush lever to be raised to said first lever position when said push-button mechanism is in said first button position and causing said flush lever to be raised to said second lever position when said push-button mechanism is in said second button position.

5. The toilet enhancement of claim 4 wherein said mechanical linkage comprises a linear gear pull which has a first end pivotally connected to said flush lever, said gear pull being mechanically engaged with a valve-raising gear, said flush lever raising said gear pull and thereby rotating said valve-raising gear, rotation of said valve-raising gear raising said flap valve.

6. The toilet enhancement of claim 5, further comprising a spring which is mechanically engaged with said flap valve, said spring applying to said flap valve which a force which pushes said flap valve toward said seated position.

7. The toilet enhancement of claim 1 wherein said timing mechanism comprises a plurality of gears, each of said gears engaging at least one other of said gears, rotation of one of said gears causing said engaged gears to rotate, said flap valve being frictionally engaged with one of said gears, the raising of said flap valve causing slippage between said flap valve and said frictionally engaged gear, said raised flap valve returning to said seated position without said slippage between said flap valve and said frictionally engaged gear.

8. The toilet enhancement of claim 7, further comprising a spring which is mechanically engaged with said flap valve, said spring applying to said flap valve which a force which pushes said flap valve toward said seated position.

9. The toilet enhancement of claim 8, wherein said mechanical linkage comprises a linear gear pull which has a first end pivotally connected to said flush lever, said gear pull being mechanically engaged with a valve-raising gear, said flush lever raising said gear pull and thereby rotating said valve-raising gear, rotation of said valve-raising gear raising said flap valve.

10. The toilet enhancement of claim 7, wherein said mechanical linkage comprises a linear gear pull which has a first end pivotally connected to said flush lever, said gear pull being mechanically engaged with a valve-raising gear, said flush lever raising said gear pull and thereby rotating said valve-raising gear, rotation of said valve-raising gear raising said flap valve.

11. The toilet enhancement of claim 10, further comprising a spring which is mechanically engaged with said flap valve, said spring-applying to said flap valve which a force which pushes said flap valve toward said seated position.

12. The toilet enhancement of claim 11, wherein said flush lever has a lowered lever position, a first raised lever position and a second raised lever position, said second raised lever position being midway between said lowered lever position and said first raised lever position.

13. The toilet enhancement of claim 2, further comprising a push-button mechanism having:

a shaft, said flush handle being pivotally connected to said flush lever by said shaft;

a push-button connected to said shaft and extending through said flush handle;

a cam connected to said shaft, said cam being adjacent to said flush lever, said cam rotating by the same amount as said flush handle;

said push-button mechanism having a first button position and a second button position, said cam having a first contact surface which is in contact with said flush lever when said push-button mechanism is in said first button position and causes said flush lever to rotate by the same amount as said flush-handle, said cam having a second contact surface which is aligned with said flush lever when said push-button mechanism is in said second button position, said second contact surface being out of contact with said flush lever when said flush handle is not depressed and being in contact with said flush lever when said flush handle is depressed halfway, full depression of said flush handle thereby causing said flush lever to be raised to said first lever position when said push-button mechanism is in said first button position and causing said flush lever to be raised to said second lever position when said push-button mechanism is in said second button position.

14. An enhancement for modifying a standard toilet to provide selectively variable amounts of water in the flushing of the toilet, the enhancement comprising:

a flap valve having a seated position, a first raised position and a second raised position;

a flush handle connected to a flush lever, said flush handle and said flush lever each extending laterally from a first axis about which said flush handle and said flush lever pivot, said flush lever having a lowered position corresponding to said lowered position of said flap valve, a first raised position corresponding to said first raised position of said flap valve and a second raised position corresponding to said second raised position of said flap valve, said flush lever being raised to one of said raised positions by depression of said flush handle and said flush lever being returned to said lowered position after the release of said flush handle;

a mechanical linkage connecting said flap valve to said flush lever, said flap valve being raised by said mechanical linkage from said seated position to one of said raised positions when said flush lever is raised, said linkage including, a mechanical timing mechanism connected to said flap valve, said timing mechanism lowering said flap valve from said range of raised positions to said seated position at a controlled rate.

15. The toilet enhancement of claim 14 wherein said mechanical linkage comprises a linear gear pull which has a first end pivotally connected to said flush lever, said gear pull being mechanically engaged with a valve-raising gear, said flush lever raising said gear pull and thereby rotating said valve-raising gear, rotation of said valve-raising gear raising said flap valve.

16. The toilet enhancement of claim 14, further comprising a push-button mechanism having:

a shaft, said flush handle being pivotally connected to said flush lever by said shaft;

a push-button connected to said shaft and extending through said flush handle;

a cam connected to said shaft, said cam being adjacent to said flush lever, said cam rotating by the same amount as said flush handle;

said push-button mechanism having a first button position and a second button position, said cam having a first contact surface which is in contact with said flush lever when said push-button mechanism is in said first button position and causes said flush lever to rotate by the same amount as said flush handle, said cam having a second contact surface which is aligned with said flush lever when said push-button mechanism is in said second button position, said second contact surface being out of contact with said flush lever when said flush handle is not depressed and being in contact with said flush lever when said flush handle is depressed halfway, full depression of said flush handle thereby causing said flush lever to be raised to said first lever position when said push-button mechanism is in said first button position and causing said flush lever to be raised to said second lever position when said push-button mechanism is in said second button position.

* * * * *